United States Patent [19]

Glan

[11] Patent Number: 4,457,080

[45] Date of Patent: Jul. 3, 1984

[54] FLEXIBLE GAGE CLAMP APPARATUS FOR SUPPORTING A FLEXIBLE GAGE LINE

[76] Inventor: Casimer J. Glan, 3732 N. Richards, Milwaukee, Wis. 53212

[21] Appl. No.: 331,961

[22] Filed: Dec. 18, 1981

Related U.S. Application Data

[63] Continuation of Ser. No. 080,096, Sep. 28, 1979, abandoned.

[51] Int. Cl.[3] ..... G01C 15/10

[52] U.S. Cl. ..... 33/404; 33/410; 33/413

[58] Field of Search ..... 33/404–410, 33/413

[56] References Cited

U.S. PATENT DOCUMENTS

| | | | |
|---|---|---|---|
| 614,577 | 11/1898 | Reineking | 33/410 |
| 1,531,652 | 3/1925 | Guillet | 33/413 |
| 2,505,935 | 2/1950 | Batchler | 33/409 |
| 2,611,963 | 9/1952 | Zinken | 33/408 |
| 2,735,183 | 2/1956 | Taylor | 33/409 |
| 3,039,195 | 6/1962 | Litty | 33/404 |
| 3,039,196 | 6/1962 | Jernigan | 33/410 |
| 3,205,582 | 9/1965 | Andrews | 33/407 |

FOREIGN PATENT DOCUMENTS

| | | | |
|---|---|---|---|
| 1136354 | 12/1968 | United Kingdom | 33/404 |

*Primary Examiner*—Charles E. Phillips

*Attorney, Agent, or Firm*—Andrus, Sceales, Starke & Sawall

[57] ABSTRACT

A guide line clamp supports a guide line in an alignment slot to accurately position the line. The clamp includes a releasable clamp body having a groove and a manually operable lever for closing a jaw onto a structural supporting flange of a T-shaped member for a drop-in panel ceiling. A guide line body extends from the clamp body and includes the alignment slot which is perpendicular to the groove and has a base aligned with the clamping surface of the groove. The inner end of the slot splits and extends laterally to the sidewalls. An offset line clamp plate is secured to the bottom of the guide line body and defines an encircling and laterally offset recess having inclined walls within which the line is wrapped and releasably gripped. The plate has edge openings for the end of the line.

8 Claims, 6 Drawing Figures

FLEXIBLE GAGE CLAMP APPARATUS FOR SUPPORTING A FLEXIBLE GAGE LINE

This is a continuation application of application Ser. No. 06/080,096, filed Sept. 28, 1979 now abandoned.

BACKGROUND OF THE INVENTION

This invention relates to a level gage line clamp apparatus for releasably supporting a flexible line during alignment of building structural elements.

In the construction of buildings, various components and elements must be aligned to define a flat or planar surface. For example, in the building of a wood wall, such as the sidewall of a conventional house, the two-by-four framing is built on a foundation. When applying of the upper floor or roof structure, it is important to have the wall elements located in a relatively flat or planar alignment. Conventionally, a carpenter will drive a nail to the opposite ends of the sidewall corners and string a line tightly between the two nails to establish a guide for visual inspection and proper alignment of the wall structure. In the building of masonry wall, for example, it is often desired to provide a means of locating bricks in rows of common horizontal planes. Conventionally, a guide line is stretched along the length of the first and last brick in each row such that all bricks therebetween can be rapidly and accurately placed in the same level. For example, U.S. Pat. No. 2,800,719 discloses a small line attachment unit which is adapted to be located in abutting engagement with the opposite ends of a brick wall. The holders are provided with an offset surface adapted to engage the adjacent sidewall lateral sidewalls extending perpendicular to the main wall. A guide line is releasably attached to the corresponding attachment units to clamp them in position and to define a chalk line position to permit accurate positioning of bricks in the row. The chalk line is threaded through the unit and then wound about an outer in-line T-shaped groove in the attachment body for releasable attachment to the holder. The clamping action requires separate holding at the opposite end while attaching of the line to create accurate location and would appear to almost require a twoman attachment. Further, in view of the threaded and interrelated outer string attachment mechanism, the device is generally inapplicable to other forms of building structures, such as a panel-type ceiling. In various buildings, a panel ceiling may be built with a supporting framework within which removable panels are supported to form a continuous ceiling wall. Thus, L-shaped wall angles are secured to the side walls and T-shaped support members are strung between the L-shaped angles. T-shaped supports may span substantial distances and conventionally wire hangers are secured between the upper ceiling structure and the T-members, spaced along their length. The main T-shaped member must be located in a rather precise level position during attachment of the wires to establish and maintain a flat ceiling. Various level devices have been employed to properly locate the main T-shaped supports in a common plane.

There is, however, a need for an alignment device which can be universally used in the formation of building structures, ceilings and the like. Such a device must provide for simple, reliable interconnection while maintaining relatively precise and accurate alignment. The cost, however, must be relatively low to justify use in normal trade.

SUMMARY OF THE PRESENT INVENTION

The present invention is particularly directed to a flexible guide line holder or apparatus having a releasable clamp unit for interconnection to a fixed wall structure or element in combination with an outwardly extending quick release line attachment means which includes a multiple armed alignment slot in combination with a side or laterally offset line clamping or gripping recess. The guide slot is located in precise predetermined relationship to the clamp unit such that the guide line is accurately located relative to the plane of the reference wall thereby permitting accurate location of the associated interconnecting members. The guide line can be passed through the alignment slot and then rapidly attached to the interconnecting laterally offset gripping recess. In use the operator attaches the guide line apparatus to spaced locations, runs the string or guide line therebetween with the ends secured to the separate holders. The alignment slot establishes accurate positioning of the line with the apparatus or holders properly clamped in position.

More particularly, in a preferred and unique embodiment of the present invention, the clamp unit includes a releasable clamp body having a groove and a manually operable means for closing of a jaw means to a supporting flange member, such as a wall flange, a nail or the like. The clamp unit projects outwardly with a guide line body which includes a locating slot extending generally perpendicular to the clamp groove. The slot terminates in aligned relationship to one clamping surface of the groove for corresponding location of the line in predetermined relationship to such surface. The inner end of the slot extends laterally to the sidewall, and preferably splits and extends laterally to the opposite sides of the body to permit extension of the line through the alignment slot and then laterally to either side of the guide line body. An offset line clamp plate is secured to the bottom surface of the guide line body and defines an encircling groove or recess around the alignment slot and within which the line may be wrapped and releasably held. The clamp plate may further be provided with edge openings to position of the end of the line extending downwardly or outwardly therethrough. The clamp groove portion is preferably provided with suitable inclined surfaces to create firm frictional engagement with the line.

The apparatus can be readily formed as a cast, molded or machined part, with a suitable releasable pivot-type means, a set screw or any other suitable quick release clamp member which is adapted to quick releasable attachment to an angle wall flange of a drop ceiling construction or the like while permitting taut positioning of the string closely adjacent the structure to be aligned for accurate positioning thereof. The apparatus can be a relatively rugged, but low cost, construction such as to adapt the apparatus to commercial production at a cost which can be readily accepted by the ordinary tradesmen.

DESCRIPTION OF THE DRAWING FIGURES

The drawing furnished herewith illustrates a preferred construction of the present invention in which the above advantages and features are clearly disclosed as well as others which will be readily understood from the following description.

DESCRIPTION OF ILLUSTRATED EMBODIMENT

Figure 1:
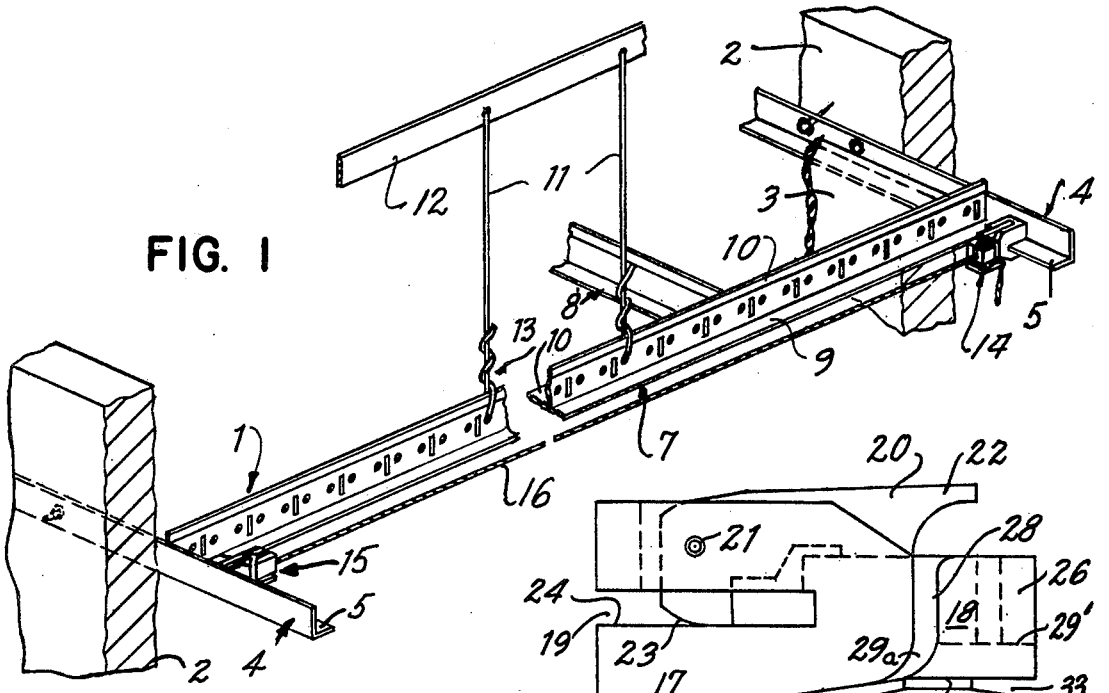
FIG. 1 is a fragmentary pictorial view illustrating the invention applied to a drop-type ceiling.

Referring to the drawings and particularly to FIG. 1, an embodiment of the present invention is particularly illustrated in connection with the formation of a drop ceiling employing a flanged supporting framework 1 interconnected to the building structure 2 and defining rectangular openings for receiving correspondingly shaped rectangular ceiling panels 3. Such a drop-in ceiling structure is widely employed in the construction of various homes, institutional buildings commercial buildings and the like. In such a ceiling structure, the framework includes L-shaped wall angles 4 secured to the vertical walls and defining inwardly projecting support flanges 5 at the desired height of the ceiling panels 3. Interconnected between the wall angles 4 are interconnected and intersecting T-shaped supports 7 and 8 which extend across the building or room span and each of which includes oppositely projecting flanges 9 and 10 essentially in the plane of the wall flanges 5 to define side supports for the panel 3.

Generally, a plurality of main T-members supports 7 are distributed in accordance with the width of the ceiling panels 3 and cross-T-members 8 rest on flanges 9 and 10 of the main members. In such structures, the main T-members 7 are supported along their length by interconnecting and supporting wires 11 attached to the old ceiling or the ceiling joists 12 and then releasably connected to the main T-member 7 as at 13 to locate and hold the flanges in the true plane relationship. Due to the length and the like, the frame members may sag, particularly with the ceiling panels in place. Such ceiling structures are of course well known and will be readily recognized by those of ordinary skill in the art. They will also recognize the difficulty which has been encountered in the rapid convenient and accurate location of flanges 9 and 10 of the main T-members 7. The present invention is particularly directed to releasable guide line clamp structures 14 and 15 which are shown interconnect to the opposite flanges 5 of the L-shaped wall angles 4. An alignment or guide line 16, which is generally a string, is secured to the clamp structures 14 and 15 and stretched therebetween to locate the string in close spaced relation to the main T-flange 9. The workmen can then readily attach the main T-member 7 and interconnect the wires to the main T-members 7 by passing the wire through the appropriate opening in the stem of the members and winding the wire upon itself as at 13. Having attached all of the necessary supporting wires 11 to properly secure the T-member in place, the worker releases the clamp structures 14 and 15 and moves to the next main T-member, again attaches the clamp structures to the wall angles 4, tightens of the guide string 16 therebetween, and proceeds accordingly.

Figure 2:
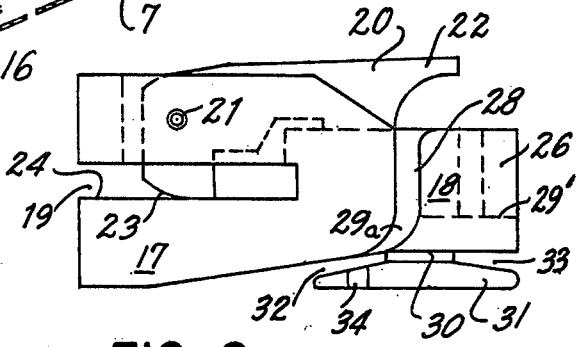
FIG. 2 is an enlarged side elevational view of a guide unit shown in FIG. 1 with the aligned line removed.
Figure 4:
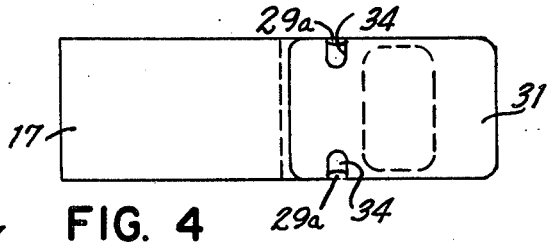
FIG. 4 is a bottom view of the guide unit.

The illustrated embodiment of the new releasable guide line clamp structure 14 is more fully disclosed in FIGS. 2 and 4. The structure 14 includes a clamp unit 17 for attachment to the wall flange 5 and a main string attachment and guide unit 18 projecting outwardly therefrom.

Figure 3:
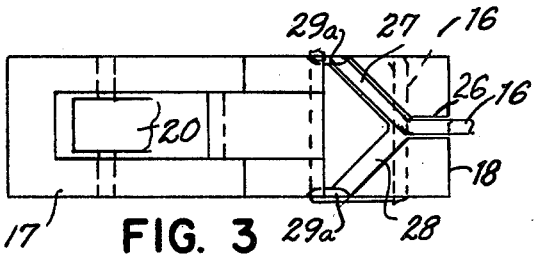
FIG. 3 is a top view of the guide unit shown in FIGS. 1 and 2.

The clamp unit 17 includes a clamping slot or groove 19 of a depth slightly greater than the thickness of a wall flange 5 or other member to which the guide line structure 14 is to be attached. Means are provided for effectively closing the groove 19 to clamp the structure in place. In the embodiments of FIGS. 2–4, a lever arm 20 is pivotally mounted within the upper wall portion of the clamp unit 17. More particularly, the clamp unit 17, as illustrated most clearly in FIGS. 2–3 is provided with a central recess or opening into the groove. The lever member 20 is pinned as by a roll pin 21 which extends through the side walls of the recess and the lever to pivotally support the lever 20. The lever 20 extends outwardly from the groove and toward the string attachment and guide unit 18, with an outer finger portion 22 provided for pivoting of the lever about the axis of pivot pin 21. The opposite end of the lever 22 extends into the clamping groove with an innermost curved end 23, which has a generally smooth radius to define a variable gap dependent upon the pivot position of the lever 20. Thus, the lever 20 can be pivoted upwardly to define an enlarged space between the lever end 23 and the opposed base or reference wall 24 of the groove to permit movement of the clamp unit 17 onto the flange 5 or the like. The lever 20 is then pressed downwardly to move the longer radius portion or end 23 onto the opposed wall of the flange to securely clamp the guide structure to the flange 5.

Particularly outwardly from the end face of the clamp unit 17 is the quick release string attachment and guide unit 18. The guide line structure 14 is shown formed as a metal element with the clamp unit 17 and the line attachment and guide unit 18 integrally formed as a single element. The attachment unit 18 is a block body having generally vertical extended Y-shaped slot having a stem slot 26 extending inwardly from the outermost end wall and with arm slots 27 and 28 extending laterally to the sidewalls of the unit. The bottom surface or ledge 29 of the stem slot 26 is located in predetermined offset relationship to the clamp reference wall 24 substantially by the depth of the alignment string 16. With the guide line structure 14 attached to the T-member flange 5, the line 16 located in the bottom of slot 26 is corrrespondingly located in the desired plane of the flange 5 to permit accurate location of the main T-member 7 in the ceiling framework 1. The sidewalls of the guide unit 18 are provided with a curved edge defining string transfer recesses 29*a* which curve from the arm slots 27 and 28 to a string holding recess 30. The string holding recess 30 is formed by a bottom plate member 31 adjacent to and integrally formed with the bottom wall of the body of guide unit 18. The string holder portion thus forms an extension of the bottom wall and is constructed to define an encircling clamping recess 30 for the string.

Figure 5:
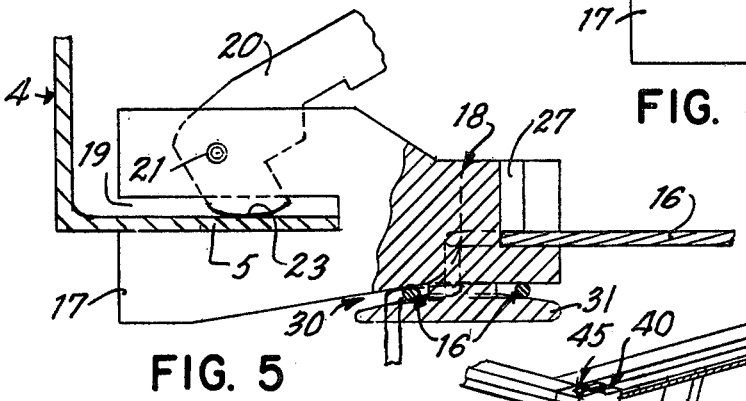
FIG. 5 is a side elevational view of the guide unit shown in FIG. 1 with parts broken away and sectioned to illustrate the location of the guide line in position.

As shown more clearly in FIGS. 2 and 5, the recess 30 includes a back inclined wall on the bottom wall of the string attachment and guide unit 18 and a similar inclined portion on the bottom member 31. The opposed inclined portions have different degrees of incline to define a gradually smaller gap 32 from the outer end of the gap to the inner end. The gap above is also aligned with the string transfer recess 29a from the end arm slots 27 and 28. The outermost or front portion of the bottom member 31 similarly includes an inclined wall opposed to a flat surface or the bottom of the guide unit 18 to a gradually reducing gap 33 within which the string 16 may be pulled. The holding plate member 31 is shown with edge slots 34 through which the end of the string 16 is located. Thus, the string 16 is pulled around the recess 30 of guide unit 18 in one or more loops with the end in the slot 34. It has been found that a single loop of the string, particularly with the overlap at the point of exit, provides a reliable and firm interconnection. The exposed multiple arm locating or guide slots 26–28 in combination with the laterally offset exposed string recess 30 permits convenient and rapid attachment and removal of the string 16 with the guide line structure located in place.

In summary, the embodiment of the invention as illustrated in FIGS. 1–4 is used by releasing of the pivot lever 20 and locating the structures 14 and 15 with the groove 19 mating with the wall flange 5 and then closing the lever to locate the reference wall 24 of the clamp apparatus 14 abutting the flange 5 and in location desired for the flanges 9 and 10 of the main T-member 7. The string 16 is appropriately attached, either before or after the attachment to the flanges 5. The string 16 is drawn taut between the structure 14 and 15 to locate the string 16 in the desired plane. The main T-member 7 is then wired in place as previously discussed. The clamp levers 20 are then released and the guide line structures 14 and 15 removed to the next location.

Figure 6:
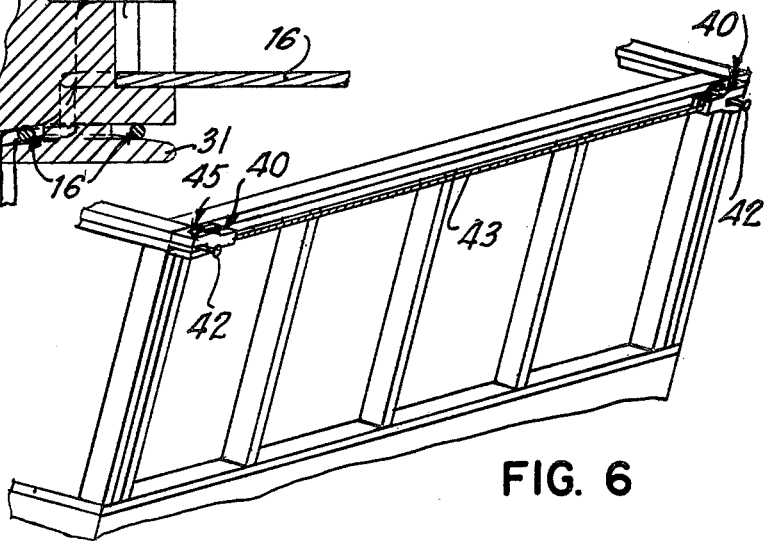
FIG. 6 is a simplified illustration of the guide unit shown for visual alignment of a building wall.

Although particularly adapted to and shown in the construction of a drop-in panel ceilings, the guide-line structures may be used in various other construction environments wherever an attachment element is or may be conveniently provided. For example as shown in FIG. 6, a guide line structure 40 is shown applied to the checking of the flatness at building wall 41 prior to attachment of the ceiling or roof joists or the like, not shown. In this instance, the workman has driven a nail 42 into the sidewall of the frame structure, and particularly to the opposite ends thereof. The guide line structures 40 is located with the clamp groove closed and attached to the nail 42. A string 43 is again attached and drawn taut between the guide line structures 40 and provides accurate line for the visual alignment of the wall. In the embodiment of FIG. 6, an alternate embodiment of the clamp unit is shown. In this instance the clamp unit is formed with a conventional set screw member 45 in place of a lever. Member 45 threads downwardly through the top wall of the clamp unit to define a clamping member opposed to the base or reference wall of the clamping groove. In this instance, the screw could be threaded through and into engagement with the base wall to define a closed opening which may be located on the nail 42.

Other modifications can be readily made by those skilled in the art to the present invention which is generally directed to the concept of the combination of the releasable clamp unit for interconnection to a support in combination with the forwardly projecting and exposed string holding or attachment means having both the multiple arm locating slot and the laterally offset quick release line clamp recess or the like.

Various modes in carrying out the invention are contemplated as being within the scope of the following claims, particularly pointing out and distinctly claiming the subject matter which is regarded as the invention.

I claim:

1. A guide line apparatus for use in aligning T-shaped support members of a drop in ceiling with a projecting member of a support structure by releasable attachment of the apparatus to said projecting member of the support structure, comprising a clamp unit having a groove with a base reference wall and said base reference wall in use being located in engagement with said projecting member of the support structure, said clamp unit having a releasable clamp member adapted to move into said groove and secure the clamp unit to the projecting member with the base reference wall engaging the support structure, a guide line unit including a block body having an outer end surface and a top surface, said body projecting outwardly and forwardly from the clamp unit opposite the groove and outwardly of the support structure, said guide line unit being connected to the clamp unit and having an elongated alignment slot substantially centrally located in said block and in spaced relation to the opposite sides of said block and projecting inwardly and downwardly respectively from said end surface and said top surface to define a bottom surface located parallel to said base reference wall but lower than the plane of said reference wall of said clamp unit by an amount substantially equal to the depth of said alignment string, said slot having a depth substantially greater than its width, at least one lateral arm slot in said block body and extending laterally at an angle from the plane of said alignment slot to one side of the guide line unit to direct an end of the string to said one side of the guide line unit, said arm slot extending from the top surface and the side surface whereby said line is adapted to be placed into said alignment slot and said arm slot from said top surface, said at least one lateral arm slot communicating with a string locking means below said alignment slot and including a line gripping recess for locking said line.

2. The apparatus of claim 1 wherein said alignment slot includes a second lateral arm slot extending laterally to the opposite side of the body from said first arm slot, and said locking means being located for direct access from either side of said body and said lateral arm slots whereby said clamp unit may be secured to the opposite support structures with the line exiting to the same side of the clamp unit.

3. The apparatus of claim 1 wherein said line gripping recess includes a progressively reduced portion immediately to the front and back portions of the recess.

4. The apparatus of claim 1 wherein said line gripping recess is in a plane substantially perpendicular to the plane of the alignment slot and with the base of the alignment slot aligned within and parallel with said recess.

5. The guide line apparatus of claim 1 including a curved edge recess connecting said arm slot and said string locking means.

6. The guide line clamp apparatus of claim 1, wherein said releasable clamp member includes a releasable clamp lever secured to a wall outwardly spaced from said reference wall in opposed relation to said reference wall and is adjustably positioned within said clamp groove and operable to frictionally grip said projecting member and force the member against said reference wall, said block body integrally formed as a block like member to said clamp unit, a second lateral arm slot extending laterally to the opposite side of said alignment slot to define a generally Y-shaped slot opening inwardly from said top surface, said string locking means including a platelike member having an interconnecting portion secured to the underside of the guide line body and defining an encircling line recess encircling said guide line slot for receiving and releasably holding the free end of the line.

7. The guide clamp apparatus of claim 6 wherein said plate-like member includes inclined walls to the opposite side of the guide line body and said body has aligned inclined walls of a different inclination to define a progressively reducing line receiving recess.

8. The apparatus of claim 6 wherein said plate-like member includes a pair of edge openings adjacent the lateral arm slots in said guide line body.

* * * * *